US007624888B1

(12) United States Patent
Pudlak et al.

(10) Patent No.: US 7,624,888 B1
(45) Date of Patent: Dec. 1, 2009

(54) LOW PRESSURE VENTING MUNITIONS CONTAINER

(75) Inventors: Daniel J. Pudlak, Andover, NJ (US); Robert Ho, Wharton, NJ (US); David Ondre, Piscataway, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 487 days.

(21) Appl. No.: 11/164,033

(22) Filed: Nov. 8, 2005

Related U.S. Application Data

(60) Provisional application No. 60/595,888, filed on Aug. 15, 2005.

(51) Int. Cl.
*B65D 90/36* (2006.01)
*F41A 9/00* (2006.01)

(52) U.S. Cl. ..... 220/89.2; 102/481

(58) Field of Classification Search ..... 220/89.4, 220/89.1, 693, 692, 677, 316, 720, 721, DIG. 16, 220/203.08, 203.01; 428/34.4; 102/481, 102/378, 377; 89/1.817, 17
See application file for complete search history.

(56) References Cited

U.S. PATENT DOCUMENTS

| | | | | | |
|---|---|---|---|---|---|
| 776,758 | A | * | 12/1904 | Rheutan | 220/692 |
| 2,105,735 | A | * | 1/1938 | Hodge | 49/193 |
| 2,737,266 | A | * | 3/1956 | Gross | 52/483.1 |
| 2,850,196 | A | * | 9/1958 | Feltz | 220/4.12 |
| 2,987,880 | A | * | 6/1961 | Kimmel | 60/255 |
| 3,074,586 | A | * | 1/1963 | Morrison | 220/592.2 |
| 3,158,062 | A | * | 11/1964 | Feiler | 89/1.81 |
| 3,199,455 | A | * | 8/1965 | Samms | 60/250 |
| 3,437,035 | A | * | 4/1969 | Weimholt | 102/369 |
| 3,780,904 | A | * | 12/1973 | Stanford | 220/316 |
| 3,789,729 | A | * | 2/1974 | Aupy | 89/1.8 |
| 3,939,967 | A | * | 2/1976 | Tenney et al. | 206/3 |
| 4,301,708 | A | * | 11/1981 | Mussey | 89/1.81 |
| 4,455,917 | A | * | 6/1984 | Shook | 89/1.817 |
| 4,476,159 | A | * | 10/1984 | Mead et al. | 427/136 |
| 4,989,752 | A | * | 2/1991 | Birtwistle et al. | 220/610 |
| 5,052,569 | A | * | 10/1991 | Cooper | 220/1.5 |
| 5,239,909 | A | * | 8/1993 | Bell et al. | 89/1.807 |
| 5,267,665 | A | * | 12/1993 | Sanai et al. | 220/88.1 |
| 5,360,129 | A | * | 11/1994 | Lee | 220/1.5 |
| 5,372,071 | A | * | 12/1994 | Richards et al. | 102/378 |

(Continued)

FOREIGN PATENT DOCUMENTS

| | | | |
|---|---|---|---|
| EP | 9509 | A1 * | 4/1980 |

(Continued)

*Primary Examiner*—Anthony D Stashick
*Assistant Examiner*—Robert J Hicks
(74) *Attorney, Agent, or Firm*—Henry S. Goldfine

(57) ABSTRACT

A container has at least one seam, the at least one seam having a joined portion and an unjoined portion. A seal seals the unjoined portion of the seam, the seal being operative to fail due to internal pressure before a remainder of the container. The container may be cylindrical, comprise metal and have at least one longitudinal seam. Generally, the joined portion comprises a weld. The seal may comprise one or more of a fluid adhesive, a gasket, a patch and an I-shaped gasket. A cover attached to the container with fasteners may at least partially cover the seal to protect it from damage.

7 Claims, 4 Drawing Sheets

U.S. PATENT DOCUMENTS 5,461,831 A * 10/1995 Michal ..... 52/1
5,585,596 A * 12/1996 Richards et al. ..... 102/378
5,685,448 A * 11/1997 Thorwesten ..... 220/203.09
5,704,514 A * 1/1998 Schoo ..... 220/652
5,735,639 A * 4/1998 Payne et al. ..... 405/129.57
5,769,257 A * 6/1998 Fleisher et al. ..... 220/1.5
5,992,328 A * 11/1999 Blain et al. ..... 102/378
5,993,921 A * 11/1999 Hunn ..... 428/34.4
6,092,272 A * 7/2000 Durham et al. ..... 29/421.1
6,298,786 B1 * 10/2001 Grosskrueger et al. ..... 102/378
6,772,877 B1 * 8/2004 Lam et al. ..... 206/3
6,976,340 B2 * 12/2005 Schulze et al. ..... 52/208
6,988,781 B2 * 1/2006 Dang et al. ..... 312/409
2006/0096449 A1 * 5/2006 Williams et al. ..... 89/1.817
2006/0131307 A1 * 6/2006 Eijkelenberg et al. ..... 220/89.2

FOREIGN PATENT DOCUMENTS

EP 407775 A1 * 1/1991

* cited by examiner

LOW PRESSURE VENTING MUNITIONS CONTAINER

CROSS-REFERENCE TO RELATED APPLICATIONS

This application is a continued prosecution application of and claims priority from a copending prior U.S. patent application Ser. No. 11/164,033, filed Nov. 8, 2005, which copending prior application is hereby incorporated by reference, and which copending prior application claims priority to a previously filed, then copending, U.S. Provisional application Ser. No. 60/595,888, filed Aug. 15, 2005, which provisional application is also incorporated herein by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to containers and in particular to storage containers for items such as munitions.

When exposed to unplanned stimuli (heat, fire, ballistic fragments, etc) packaged munitions (ammo) within confined containers are at high risk of reacting violently. Proper implementation of vents on ammunition containers allow pressure relief, thereby helping to maintain a controlled burn compliant with MIL-STD-2105C. MIL-STD-2105C contains insensitive munitions (IM) tests and requirements. In conjunction with other IM technologies, properly vented ammo containers can comply with MIL-STD-2105C requirements.

One prior art method of container venting was to replace a steel container base or sections of the container body with a low melting point, plastic-matrix composite. This method involved replacing the base and/or sections of the container body with welded flanges, screws and composite materials. These known methods are labor intensive, costly and do not always result in a container that fully complies with IM standards as set forth in MIL-STD-2105C.

SUMMARY OF THE INVENTION

It is an object of the invention to provide vented containers that allow the contained material to react in a non-violent manner when subjected to unplanned stimuli.

It is another object of the invention to provide a container that uses the features of known non-vented containers to construct a vent opening.

Still another object of the invention is to provide a vented container wherein the vent opening is formed along a seam of the container.

It is a further object of the invention to provide a vented container wherein the vent openings are sealed sufficiently to pass a three psi leak test.

Yet another object of the invention is to provide a vented container wherein the vent openings expand in size as the contained material initiates.

One aspect of the invention is an apparatus comprising a container having at least one seam, the at least one seam having a joined portion and an unjoined portion. The apparatus may further comprise a seal for sealing the unjoined portion of the seam, the seal being operative to fail due to internal pressure before the remainder of the container.

In some embodiments, the joined portion comprises a weld. The seal may comprise one or more of a fluid adhesive, a gasket, a patch and an I-shaped gasket. A cover may be used to at least partially cover the seal. The seal should be effective for at least a three psi differential.

Another aspect of the invention is a method of making a container comprising rolling sheet metal; joining the sheet metal along a seam; interrupting the joining for a portion of the seam; resuming joining along the seam; and sealing the unjoined portion of the seam to form a seal that is operative to fail due to internal pressure before a remainder of the container. In some embodiments, the joining step and the resuming step includes welding.

Yet another aspect of the invention is an apparatus comprising a container having a plurality of panels, at least one of the panels having an opening formed therein; and a seal for sealing the opening, the seal being operative to fail due to internal pressure before a remainder of the container. The seal should be effective for at least a three psi differential. In some embodiments, the at least one panel includes a seam, the opening being formed in the seam.

Still another aspect of the invention is a method of making a container comprising bending sheet metal; joining the sheet metal along a seam; interrupting the joining for a portion of the seam; resuming joining along the seam; and sealing the unjoined portion of the seam to form a seal that is operative to fail due to internal pressure before a remainder of the container. The sealing step may include forming a seal that is effective to at least a three psi differential.

A further aspect of the invention is a method of making a metal container comprising forming an opening in the metal container; and sealing the opening with a seal that is operative to fail due to internal pressure before a remainder of the metal container. The sealing step may include forming a seal that is effective to at least a three psi differential.

A still further aspect of the invention is an apparatus comprising a metal container having a plurality of panels, at least one of the panels having an opening formed therein; a flange disposed on an interior of the container around the opening; and a cover plate disposed on an exterior of the container around the opening, the cover plate being fastened to the flange, the cover plate being operative to fail due to internal pressure before a remainder of the metal container. The cover plate is effective to seal the container up to at least a three psi differential.

Another aspect of the invention is an apparatus comprising a metal container having a lid; and a wire attached to the metal container and operable to fix the lid in a closed position, the wire being operative to fail due to internal pressure before a remainder of the metal container.

A further aspect of the invention is an apparatus comprising a metal container having a lid; a plate attached to the metal container; and a wire attached to the plate and operable to fix the lid in a closed position; the plate being operative to fail due to internal pressure before a remainder of the metal container.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention was developed for use in containing munitions that comprise energetic materials such as explosives, propellants and pyrotechnics. However, the invention is equally applicable to non-combat or civilian uses where containers for energetic material are used. The invention may be applied to a wide variety of ammunition and munitions containers. The invention uses low cost materials and procedures to reduce the internal container pressure when the container is subjected to unplanned stimuli.

In general, the vents of the invention comprise pre-opened sections (for example, unwelded or pre-cut sections) in the container that are sealed with filler material. An over-patch may be added to further protect the container contents from adverse environments. The sealed pre-opening allows container venting at low pressure and controls the burning rate of the enclosed energetic materials to avoid violent reactions.

Two examples of methods for making pre-opened vent sections are: 1) leaving portions of the container seams unjoined (the container seams are normally joined along their entire length by, for example, welding) and 2) cutting openings, for example, slots, in the container. The size of the pre-opened section depends upon the overall weight, length, diameter, contents and specific system requirements of the container. In embodiments of the invention that use a narrow pre-opened seam, the length of the seam may vary, for example, from about 0.001 inches to about 12 inches.

Munitions containers must also comply with MIL-STD-1904, specifically the leak test. To pass the leak test, the pre-opened vent section (as well as the rest of the container) must be sealed to maintain an internal pressure of 3 psi before and after rough handling. Silicone adhesive/sealant and neoprene are the preferred sealing materials, although other materials may be used for sealing. In some embodiments, a protective cover for the seal, such as a metal plate, is attached with or without fasteners to the vent section on the external surface of the container. The protective cover helps to mitigate the risks of leakage, long term storage and other logistics issues.

One embodiment of a method of making a vented container according to the invention comprises: 1. Rolling sheet metal; 2. Joining the sheet metal along a seam by, for example, welding; 3. Interrupting the joining for a specified length along the seam; 4. Resuming joining along the seam; 5. Sealing the unjoined portion of the seam. 6. Completing fabrication of the container using conventional techniques.

Figure 1:
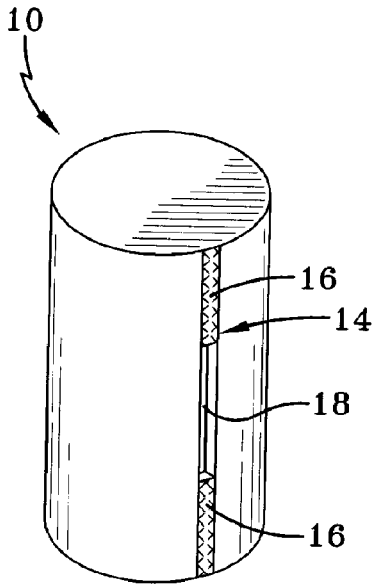
FIGS. 1 and 2 schematically show containers according to the invention.

FIG. 1 shows one embodiment of a container 10 according to the invention. Container 10 has at least one seam 14 formed, for example, by placing the ends of flat sheet stock adjacent each other. In conventional containers, seam 14 is joined along its entire length, for example by welding, to provide a leak proof container. In the invention, however, the joining process is interrupted to provide an unjoined portion 18 and a joined portion 16. Preferably, the container is made of a metal. For cylindrical containers 10 as shown in FIG. 1, the seam 14 is preferably located parallel to the longitudinal axis of the cylinder.

Figure 2:
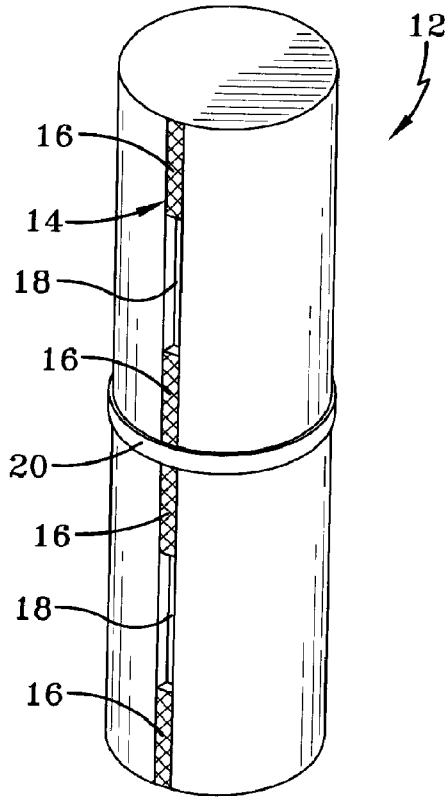

FIG. 2 shows another container 12 wherein the seam 14 includes two unjoined portions 18. It is also possible to have more than two unjoined portion 18, if needed. In some cases, multiple unjoined portions 18 may be needed when the container 12 has a structure such as a stacking ring 20 disposed about its circumference. The stacking ring 20 may stop the seam 14 from splitting once the split reaches the ring 20. Therefore, it may be advantageous to provide unjoined portions 18 on either side of stacking ring 20. The unjoined portions 18 are not merely a fixed sized vent for escaping gases. Rather, the openings at the unjoined portions 18 are designed to expand in size both along the seam 14 and transverse to the seam 14 as the pressure in the container increases.

As discussed above, the opening defined between the unjoined portions 18 must be sealed well enough to pass a 3 psi leak test. Therefore, a seal is provided at the unjoined portion 18. When internal pressure builds up in the container, the seal will fail due to the internal pressure before the remainder of the container fails.

Figure 3:
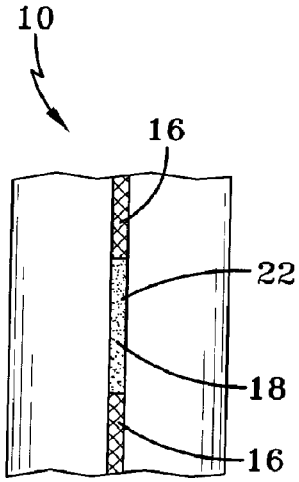
FIGS. 3, 4 and 5 are schematics of a portion of a container.
Figure 4:
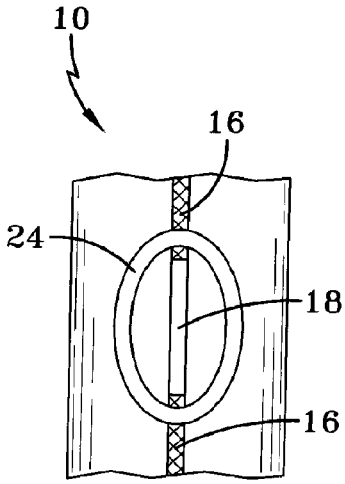
Figure 5:
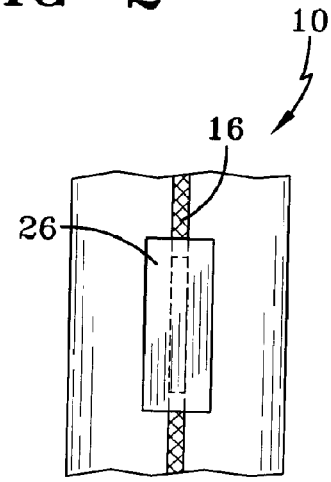

FIG. 3 shows a portion of a container 10 wherein the seal at the unjoined portion 18 comprises a fluid adhesive 22, for example, silicon. FIGS. 4 and 5 show a container 10 wherein the seal comprises a gasket 24 that surrounds the unjoined portion 18 and a patch 26 placed over the unjoined portion 18. Patch 26 may be made of, for example, neoprene, and gasket 24 may be made of, for example, silicon. Patch 26 may be used without the gasket 24. The fluid adhesive 22 may, of course, be used in combination with the patch 26 or the patch 26 and gasket 24.

Figure 6:
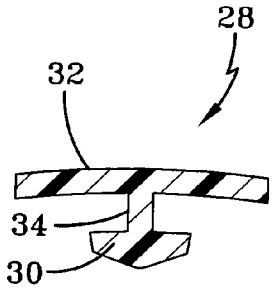
FIG. 6 is a cross-section of a seal.

FIG. 6 is a sectional view of an I-shaped gasket 28 made of, for example, neoprene. I-shaped gasket 28 may have a narrow flange 30, a wide flange 32 and a web 34. Or, the flanges 30, 32 may be the same width. Typically, the narrow flange 30 is disposed against the interior surface of the container, the wide flange 32 is disposed against the exterior surface of the container and the web 34 lies in the space in the unjoined portion 18. The seal may comprise the I-shaped gasket 28 only or the I-shaped gasket 28 in combination with one or more of the fluid adhesive 22 and the patch 26.

Figure 7:
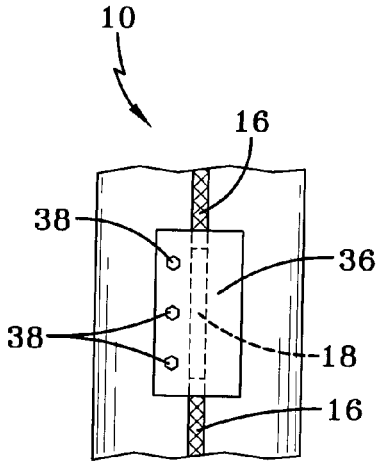
FIGS. 7 and 8 are schematics of a portion of a container.
Figure 8:
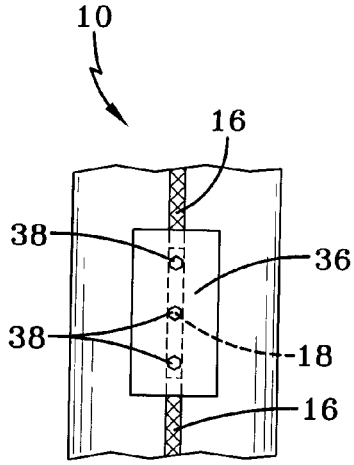

Any one of the seals described above may be used in combination with a cover disposed on the exterior surface of the container wherein the cover at least partially covers the seal. The cover is usually made of a harder material than the materials of the seal. The cover may be made of, for example, a metal or plastic. The function of the cover is to protect the seal from damage. FIGS. 7 and 8 show portions of a container 10 having a cover 36 over the seal. The cover 36 is attached to container 10 using fasteners 38, for example, rivets or bolts and nuts. In FIG. 7, the fasteners 38 are located adjacent, but not in, the unjoined portion 18. Thus, as the unjoined portion 18 begins to separate due to internal pressure, the cover 36 will not impede expansion of the opening at the unjoined portion 18 because the fasteners 38 are all disposed on one side of the unjoined portion 18. Similarly, in FIG. 8, fasteners 38 are disposed directly in the seam of the unjoined portion 18 such that the cover 36 will not impede expansion of the opening at the unjoined portion 18.

Figure 9:
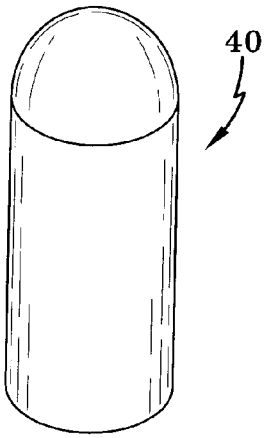
FIG. 9 is a schematic of a munition.

In some embodiments of the invention, the container will store a munition 40, shown in FIG. 9, or some other device containing an energetic material. In other embodiments, the container may store devices that are not classified as munitions, such as fuzes, pyrotechnic materials, commercial explosive devices, etc.

Figure 10:
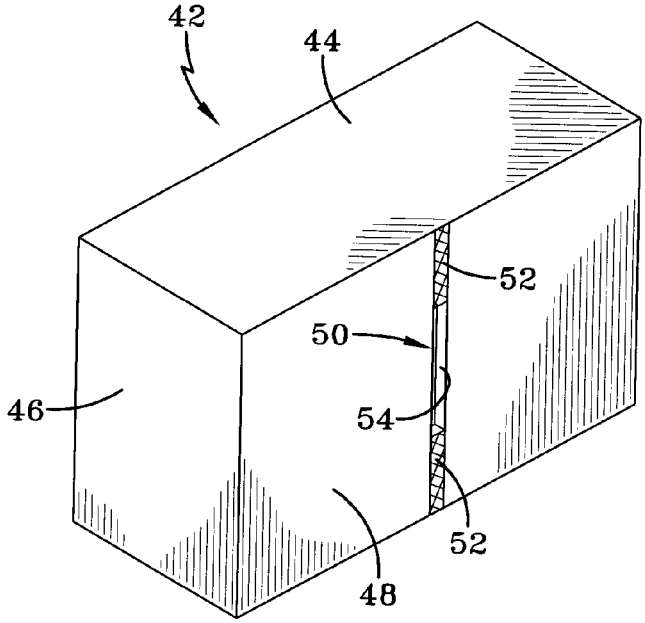
FIGS. 10 and 11 are schematics of containers according to the invention.

The invention is equally applicable to containers other than cylindrical containers. For example, FIG. 10 shows a generally rectangular container 42 having a top 44, ends 46 and sides 48. Side 48 includes a seam 50 comprising joined portions 52 and an unjoined portion 54. In the case of a container such as container 42, it is preferable to locate the unjoined portion 54 in a seam 50 that is located in a surface that has the largest surface area. Thus, it is better to have the unjoined portion 54 located in side 48 rather than end 46. The unjoined portion 54 could be used on surface 46 with a corresponding effect on vent performance. The larger surface area of side 48 results in a surface that is easier to rip open as the opening in the unjoined portion 54 expands. While the seam 50 is shown in a vertical position in FIG. 10, it may also be horizontal or angled. The unjoined portion 54 may be sealed by any combination of the seals discussed above with regard to container 10.

Figure 11:
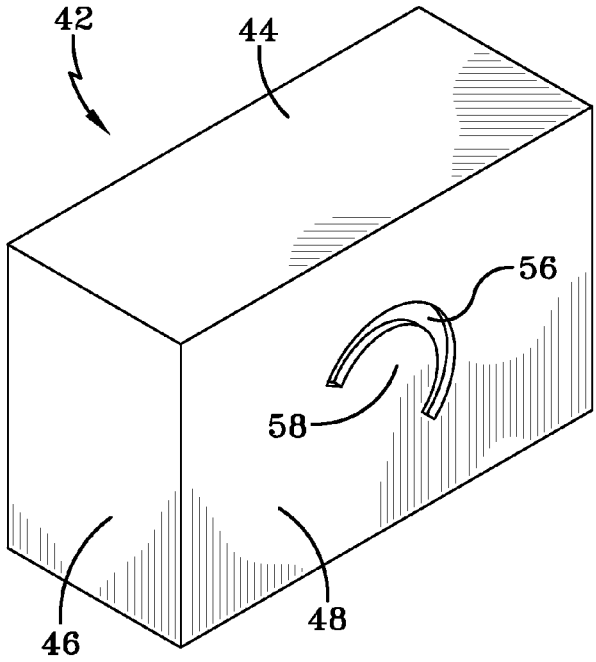

Another embodiment of the invention is shown in FIG. 11. FIG. 11 shows the generally rectangular container 42 of FIG. 10, but without the seam 50. Now, the container 42 includes an opening 56 formed in the side 48. As discussed above with regard to seam 50, it is preferable for opening 56 to be in a surface with a large surface area. The opening 56 is not an unjoined portion of a seam, but is a cutout in the side 48. One preferred shape shown in FIG. 11 is that of an arc. When using the arc shaped opening, the flap 58 of material located inside the arc is especially likely to deform outward and help rip the side 48 of the container 42. The opening 56 may be sealed by any combination of the seals discussed above with regard to container 10. Sealed openings like 56 may be added to other areas of the container.

Figure 12B:
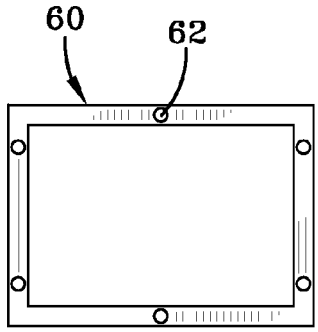
FIG. 12B shows a flange.
Figure 12A:
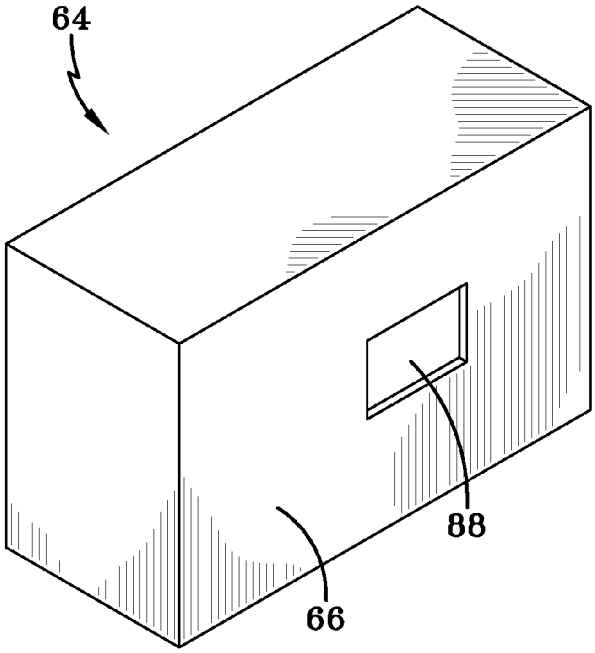
FIG. 12A is a schematic of a container according to the invention.
Figure 12C:
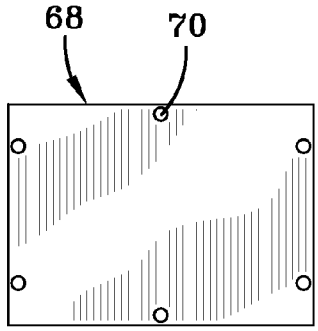
FIG. 12C shows a cover plate.

FIGS. 12A-C show another embodiment of the invention applicable to a metal container 64 having a side panel 66. An opening 88 (for example, a rectangular opening) is cut into the panel 66 of the container 64. A flange 60 is disposed on the interior of the container 64 around the opening 88. A cover plate 68, which can be constructed of metal, plastic or similar material, is disposed on the exterior of the container 64 to cover and seal opening 88. The cover plate 68 must make a seal that withstands at least 3 psi differential pressure. Both flange 60 and cover plate 68 preferably have corresponding holes 62, 70 formed therein for receiving fasteners that are used to secure the flange 60 and cover plate 68 to each other, with the panel surface 66 therebetween. In this embodiment of the invention, it is the cover plate 68 that will fail before the remainder of the container 64. In contrast to the above-described embodiments, the opening 88 is not designed to rip a larger opening in the container. The cover plate 68 may be made of thin aluminum.

Figure 13:
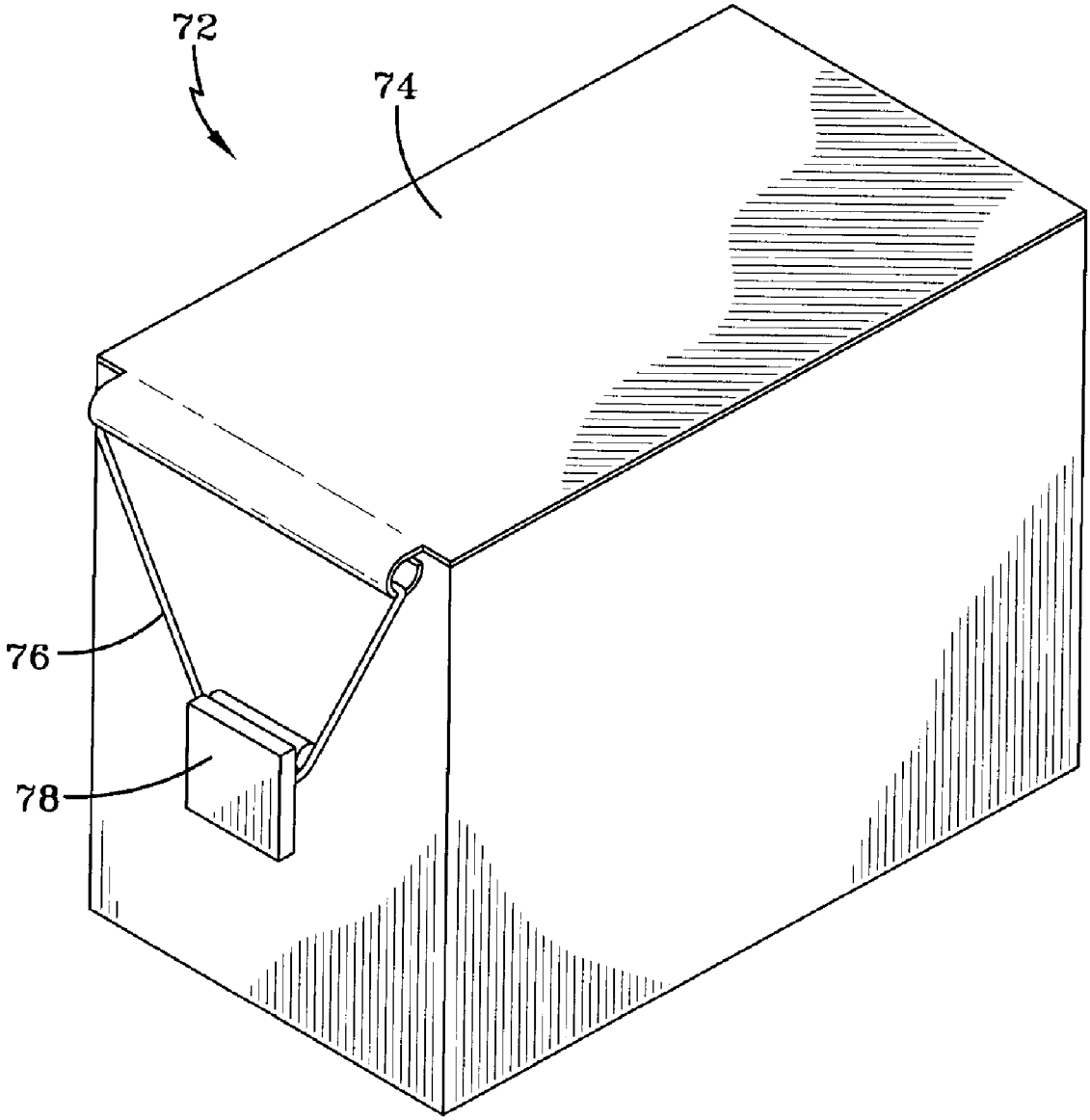
FIG. 13 shows a metal container.

FIG. 13 shows a metal container 72 with a lid 74 that is attached to the container using a plate 78 and wire 76. The plate and wire are a known mechanism for securing ammo containers. The wire 76 is attached to the metal container 72 at the plate 78 and removably attached to the lid 74. Wire 76 is operable to fix the lid 74 in a closed position. In accordance with the invention, the wire 76 has a strength such that it will withstand a 3 psi pressure differential, but will fail due to container internal pressure before a remainder of the metal container 72. In an alternative embodiment, the wire 76 is of conventional strength, while the plate 78 has a strength such that it will withstand a 3 psi pressure differential, but will fail due to container internal pressure before a remainder of the metal container 72. The internal pressure increases as a result of unplanned stimuli such as heat or fire.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. An apparatus for containing munitions, which when subject to an unplanned stimuli that causes the munition to burn vents, comprising:

a container having a top, a bottom, and at least one side therebetween;

said container having disposed therein a munition, containing therein, an energetic material selected from the group consisting of an explosive, a propellant, and a pyrotechnic;

said container having at least one seam located within said side, the at least one seam having a joined portion and an unjoined portion; and a seal, consisting of a material selected from the group consisting of an adhesive and a sealant, for sealing the unjoined portion of the seam, the seal being operative to fail when the internal pressure is at least three psi greater than the external pressure, before a remainder of the container fails;

thereby venting said container, and thereby, controlling the burn rate of the enclosed energetic material avoiding any violent reaction.

2. The apparatus of claim 1 wherein the container comprises metal.

3. The apparatus of claim 1 further comprising a cover that at least partially covers the seal.

4. The apparatus of claim 1 further comprising a munition disposed in the container.

5. The apparatus of claim 1 further comprising energetic material disposed in the container.

6. The apparatus of claim 1 wherein said adhesive is a silicone adhesive.

7. The apparatus of claim 1 wherein said sealant is selected from the group consisting of a silicone sealant and a neoprene sealant.

* * * * *